United States Patent [19]

Horiuchi

[11] 4,260,865

[45] Apr. 7, 1981

[54] CIRCUIT BREAKER

[75] Inventor: Toshiaki Horiuchi, Amagasaki, Japan

[73] Assignee: Mitsubishi Denki Kabushiki Kaisha, Tokyo, Japan

[21] Appl. No.: 63,087

[22] Filed: Aug. 2, 1979

[30] Foreign Application Priority Data

Aug. 31, 1978 [JP] Japan ..... 53-107113

[51] Int. Cl.[3] ..... H01H 3/04

[52] U.S. Cl. ..... 200/320; 200/153 H; 200/324

[58] Field of Search ..... 200/153 G, 153 H, 153 V, 200/153 SC, 154, 318, 320, 323, , 324, 325, 327

[56] References Cited

U.S. PATENT DOCUMENTS

| | | | |
|---|---|---|---|
| 3,134,879 | 5/1964 | Gauthier et al. | 200/318 |
| 3,573,415 | 4/1971 | Gryctko | 200/168 |
| 3,689,720 | 9/1972 | Patec | 200/153 SC |
| 3,875,360 | 4/1975 | Rys | 200/153 SC |

FOREIGN PATENT DOCUMENTS

| | | | |
|---|---|---|---|
| 1121073 | 7/1956 | France | 200/318 |
| 265645 | 3/1950 | Switzerland | 200/320 |

*Primary Examiner*—Willis Little

*Attorney, Agent, or Firm*—Oblon, Fisher, Spivak, McClelland & Maier

[57] ABSTRACT

A circuit breaker includes a lever which is connected to a spring mechanism at one point between both ends of the lever; a movable contact connected to one end of the lever; a stationary contact placed to face the movable contact; a fitting mechanism which is formed on the lever at a position of the movable contact side from the position connecting to the spring mechanism; and a ratchet mechanism which fits to the fitting mechanism so as to fit said lever at the position when the other end of the lever is shifted to a predetermined position against the force actuating the spring mechanism.

3 Claims, 5 Drawing Figures

CIRCUIT BREAKER

BACKGROUND OF THE INVENTION

The present invention relates to an improvement of an operating mechanism for a circuit breaker.

A conventional operating mechanism for a circuit breaker is shown in FIG. 1 wherein the reference numeral (1) designates an operating handle; (2) designates a spring one end of which is connected through a pin (14) to the operating handle (1); and the other end of the operating handle (1) is connected to fulcrum (10) formed on the box (16). The other end of the spring (2) is connected to a connecting shaft (6) of the lever (8) and the lever (13). The lever (8) is connected to a movable part which is rotatably connected through an arm (15) at one end to a stationary shaft (9) including the movable contact (3). The movable contact (3) faces a stationary contact (4) to form a pair of switch electrodes. The other end of the lever (13) is connected to a hook (7) which is rotatably connected through the shaft (5) to the stationary shaft (11). The end of the hook (7) is fitted to a lock (12) which is actuated by a tripping mechanism (not shown). FIG. 1 shows the reset opening stated.

The operation of the embodiment will be illustrated.

When the operating lever (1) is turned in the clockwise direction, the pin (13) is rotated around the center of the fulcrum (10) whereby the spring (2) connected to the shaft (6) is gradually actuated. The force applied to the spring (2) is the force for rotating clockwise the lever (13) around the center of the shaft (5) until it reaches from A to B. When the movable contact (3) is in the opening state, by the movement of the lever (8), the movement of the contact is controlled. When it moves over B, the lever (13) is rotated in the counter-clockwise direction by the force actuated by the spring (2). As a result, the shaft (6) swings to the right direction whereby the lever (8) turns in the clockwise direction so as to push down the shaft (15) and the movable contact (3) is closed.

Thus, when the operating lever (1) is turned to the left direction from the closed state, the lever (13) is turned in the clockwise direction by the reverse movement, whereby the movable contact (3) is opened to be in the state shown in FIG. 1 and the contact of the movable contact is released.

On the other hand, when a lock (12) is turned to the left by the movement of the tripping mechanism (not shown) to release the interlocking with the hook (7), the hook (7) is freely turned to the clockwise direction around the ceter of the shaft (11) even though it is in the closed state or the closing state whereby the shaft (6) is raised by the force of the spring (2) so that the movable contact (3) moves into in the opening state.

The operating mechanism of the conventional circuit breaker has such structure. Therefore, the force of the spring (2) is not directly transmitted to the movable contact, but is applied through the toggle formed by the levers (13) and (8). The output is obliged to utilize a part of the force of the spring (2). Therefore, it is necessary that the spring (2) is undesirably larger. Thus, it is necessary that the structure of the shaft or the lever should be durable to a stress greater than the force required for closing or opening the contacts of the circuit breaker. Thus, it is difficult to form a compact structure economically.

On the other hand, the lever is operated at special angles and the positions of the levers (8) and (13), the operating lever (1), the hook (7) and the spring (2) are superposed three dimensionally whereby the supports, the structures and the arrangements are complicated. Usually, only the hook (7) has one arm and the spring (2), the lever (8), the lever (13) and the operating lever (1) respectively have two arms. The number of the parts is large and high technical skill and long experimentation are required in its assembly, disadvantageously. Moreover, when the operating lever (1) is turned over the line B in the closing operation, the operating lever itself is quickly turned to right by the force of the spring (2). When the lock (12) is released, the operating lever itself is quickly shifted to the free position whereby it may cause damage to an operator. The trip state caused by the releasing operation of the lock (12) can be given at the position being different from the opening position of the operating lever (2). Therefore, it is necessary to provide a reset position for interlocking the lock (12) with the hook (7) in order to shift it from the trip state to the closing state. Moreover, it is necessary to apply by an operator, the operating force being substantially the same as the force required for closing it at the its opening operation or the resetting operation to actuate the spring (2).

SUMMARY OF THE INVENTION

It is an object of the present invention to provide a circuit breaker which is compact and light weight and safe.

Another object of the present invention is to provide a circuit breaker having a simple structure.

An additional object of the present invention is to provide a circuit breaker whose operation is simple.

A further object of the present invention is to provide a circuit which is simply convertible by a manual operation or an automatic operation.

DETAILED DESCRIPTION OF THE PREFERRED EMBODIMENTS

Figure 1:
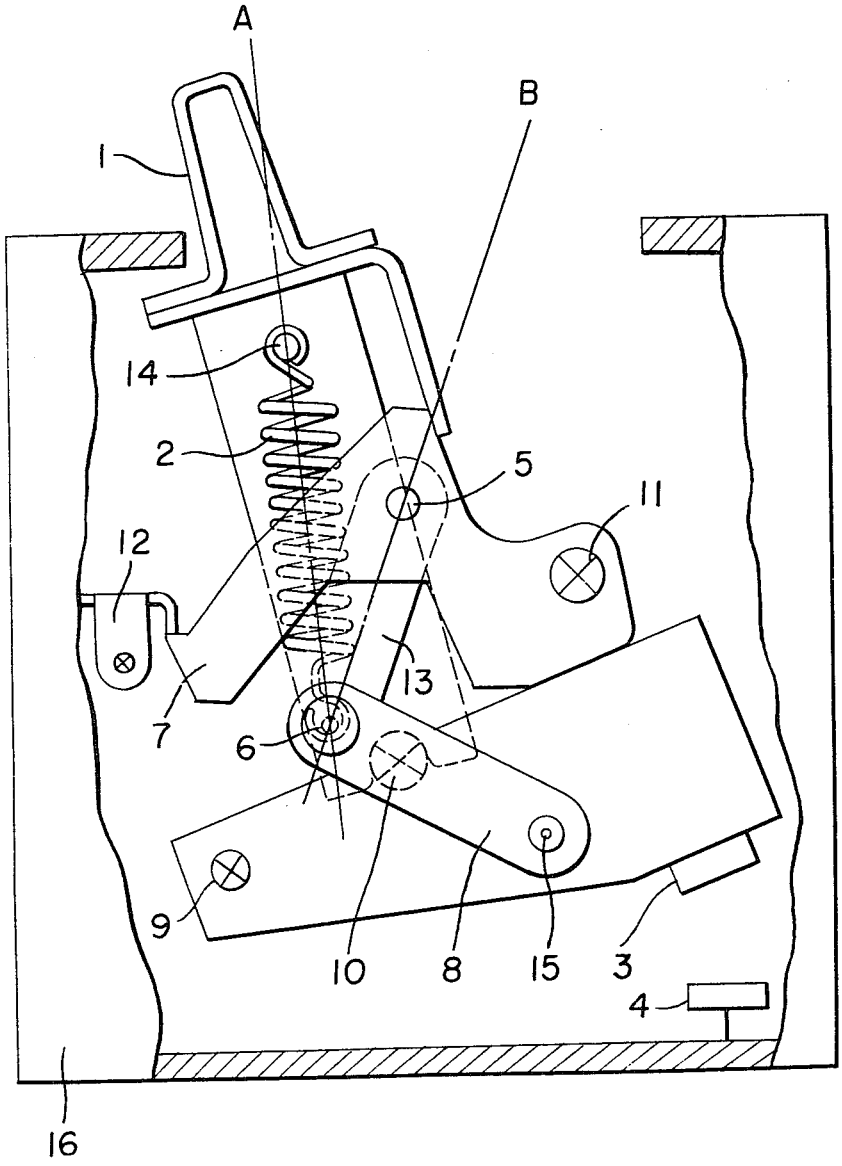
FIG. 1 PRIOR ART
FIG. 1 is a sectional side view of an operating mechanism of a conventional circuit breaker.

The present invention serves to overcome the above-mentioned disadvantages of the conventional circuit breaker.

The present invention also provides an operating mechanism of a circuit breaker which is compact, light weight and safe wherein a fulcrum is varied by a spring connected to one lever so as to perform freely the closing and opening operations.

Referring to the drawings, one embodiment of the present invention will be illustrated.

Figure 2:
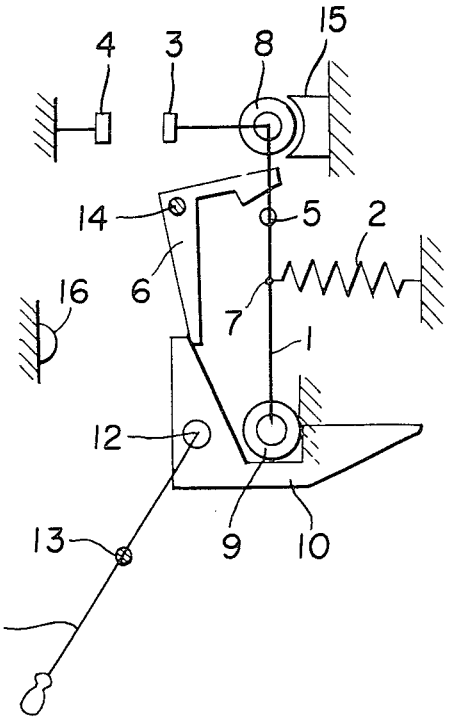
FIG. 2 is a schematic view of one embodiment of the present invention.

In FIG. 2, the reference numeral (11) designates an operating lever which is rotatably held on a shaft (13). The other end of the operating lever is interlocked through a shaft (12) to a closing hook (10) which is flexibly connected by a certain mechanism (not shown) so as to turn in the counter-clockwise direction.

A movable contact (3) of the circuit breaker is connected to one end of a lever (1) and has a rotary roll (8)

which is detachably fitted to a stopper (15). A stationary contact (4) faces the movable contact (3) with a predetermined gap. A roller (9) is connected on the other end of the lever (1) and is fitted to a groove of the closing hook (10). The tensioning spring (2) is connected to one point (7) in the middle of the lever (1). A pin (5) is connected between the roller (8) of the lever (1) and the one point (7). A closing ratchet (6) which is slanted to the left around a shaft (14) is provided in the left side of the pin (5). The closing ratchet (6) is connected to the shaft (14) under spring force, so as to turn in the clockwise direction.

The operation of the circuit breaker having the above-mentioned structure will be illustrated.

In FIG. 2, when the operating lever (11) is turned in the counter-clockwise direction the roller (9) fitted to the groove of the closing hook (10) is shifted to the left direction and the lever (1) is turned in the clockwise direction around the roller (8) as the shaft whereby the tensioning spring (2) is actuated. They are arranged so as to fit the pin (5) connected to the lever (1) to the groove of the closing ratchet (6) just before contacting the left end of the hook (10) with the stopper (16).

Figure 3:
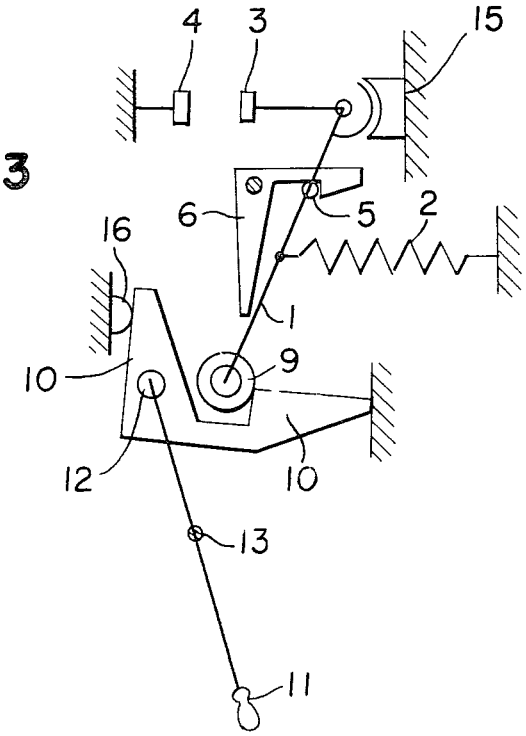
FIGS. 3, 4 and 5 are respectively schematic views for illustrating the operations of the operating mechanism of FIG. 2.

FIG. 3 shows the state of the ratchet of the embodiment.

When the operating lever (11) is turned in the counter-clockwise direction from the state as shown in FIG. 3, the left upper part of the closing hook (10) is fitted to the stopper (16) whereby the closing hook (10) starts the rotation in the clockwise direction around the shaft (12). As a result, the roller (9) fitted in the groove of the closing hook (10) is released from the fitted state. The lever (1) is turned in the counter-clockwise direction around the pin (5) by the force of the tensioning spring (2) whereby the movable contact (3) contacts with the stationary contact (4) to form the closed state which is shown in FIG. 4.

Figure 4:
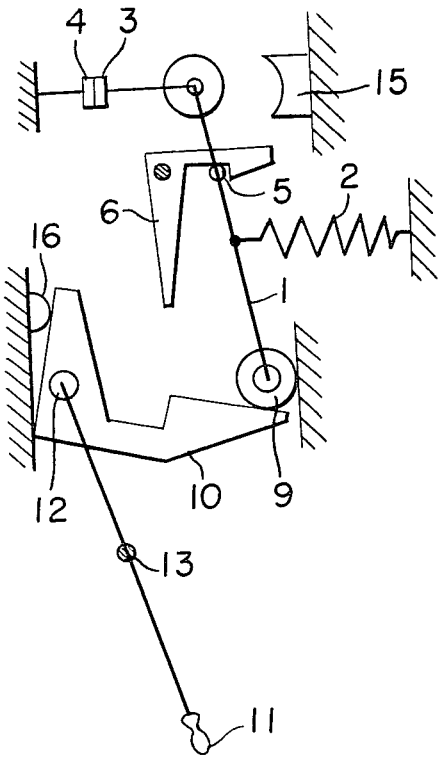

When the circuit breaker is opened from the state as shown in FIG. 4, the operating lever (11) is turned in the clockwise direction whereby the closing hook (10) shifts to the right. One end of the closing hook (10) contacts with the closing ratchet (6) just before the roller (9) fits back into the groove of the closing hook (10) whereby the closing ratchet (6) is turned in the counter-clockwise direction and the pin (5) fitted to the groove is detached and the lever (1) is turned in the clockwise direction around the roller (9) by the tensioning spring (2) so as to detach the movable contact (3). The roller (9) is fitted again into the groove of the closing hook (10) to give the state as shown in FIG. 2 which is the opening state.

On the other hand, in the closed state (FIG. 4) or the closing state, when the closing ratchet (6) is turned in the counter-clockwise direction by the output of the tripping mechanism (not shown), the circuit breaker is immediately opened or it maintains the opening state to prevent the closing, because the state that the closing ratchet (6) is fitted to the pin (5) can not be given. That is, the trip free mechanism can be easily obtained.

Figure 5:
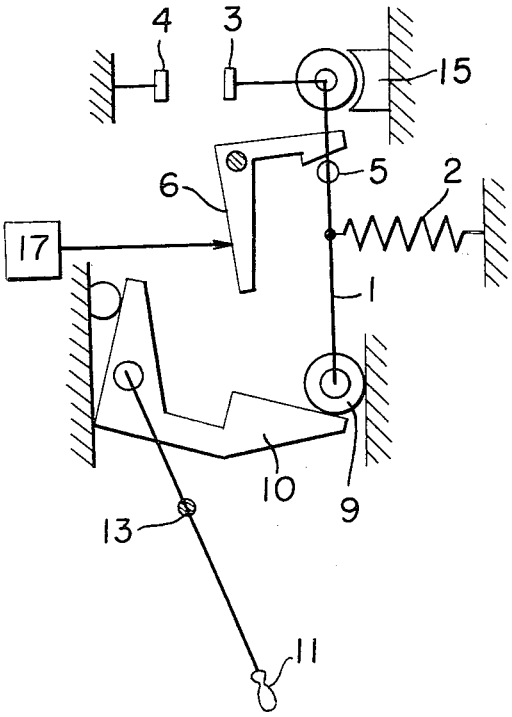

FIG. 5 shows the trip free state wherein the closing ratchet (6) is turned by the tripping mechanism (17).

In accordance with the embodiment of the present invention, the closing and opening operation at a constant speed regardless of the operating speed can be provided by the force of one tensioning spring (2) when the operating lever (11) is turned to the predetermined direction. Moreover, the trip free mechanism can be easily obtained by releasing the fitting between the closing ratchet (6) and the pin (5).

In such embodiment, the manual operation thereof has been illustrated. Thus, the same effect can be obtained by an automatic operation employing an operating source such as an electromagnet a motor, air or hydraulic cylinder. It is also possible to form a circuit breaker having closing predominant function which provide the closing state in the cases of FIGS. 2, 3 and 5 and the opening state in the case of FIG. 4, by forming the stopper (16) as a stationary contact and forming the stationary contact (4) as a stopper and placing the movable contact (3) to the right side of the roller (8).

In FIG. 5, the embodiment having the separate tripping mechanism (17) is illustrated. The break of overcurrent can be performed by the circuit breaker itself depending upon the current passing through the circuit breaker by forming one arm of the closing ratchet (6) with a bimetal.

In accordance with the present invention, the operating force required for closing and operating can be given by one spring and the movable contact is closed or opened by varying the fulcrum of one lever connected to the spring. Thus, it is unnecessary to form an assembly having high strength and complicated arrangements in three dimensions which should result in the utilization of the partial spring force in the conventional circuit breaker. The operating lever is only for closing or for opening and accordingly, it is unnecessary to provide the reset position which is not easily found. The spring is actuated only for the closing operation. Only simple operation for detaching the ratchet is required for the opening operation. The reset can be simply carried out without substantial labor for an operator by returning the operating lever to the opening position in the free state. In the opening and closing operation, the operating lever is not moved by its reaction safely though the movement of the operating lever by its reaction has been found in the conventional circuit breaker.

What is claimed as new and desired to be secured by Letters Patent of the United States is:

1. A circuit breaker comprising:

a spring mechanism;

a lever which is connected to said spring mechanism at a point between opposite ends of said lever;

a rotary roller which includes a rotary shaft rotatably fitted to one end of said lever;

an arm having one end operatively connected to the rotary shaft of said roller;

a movable contact connected to the other end of said arm;

a stationary contact facing said movable contact;

a stopper for said rotary roller positioned at a side of said rotary roller opposite the side of said contacts;

a fitting mechanism fitted to said lever between said movable contact and the position of connection of said spring mechanism to said lever;

a ratchet mechanism operatively engageable with said fitting mechanism to position the lever at a first position when the other end of said lever is shifted to a predetermined position against the force of said spring mechanism;

a roller connected to the other end of said lever;

a closing hook operatively engageable with said roller, one end of which is rotatably supported and on which a force is applied so as to maintain said fitting mechanism at the other end;

a stopper for cooperating with said closing hook; and means for turning said closing hook, whereby said contacts are positioned in a closed or opened state by movement of said lever under spring force of said spring mechanism by engagement with or release of said fitting mechanism from said ratchet mechanism.

2. A circuit breaker comprising:

a spring mechanism;

a pivotable lever which is connected to said spring mechanism at a point between opposite ends of said lever;

a shiftable rotary roller which includes a rotary shaft rotatably fitted to one of said lever;

an arm having one end operatively connected to the rotary shaft of said rotary roller;

a movable contact connected to the other end of said arm;

a stationary contact facing said movable contact;

a stopper for said rotary roller positioned at a side of said rotary roller opposite the side of said contacts;

a fitting mechanism fitted to said lever between said movable contact and the position of connection of said spring mechanism to said lever; and a ratchet mechanism operatively engaged with said fitting mechanism to position the lever at a first position when the other end of said lever is shifted to a predetermined position against the force of said spring mechanism whereby said contacts are positioned in a closed or opened state by movement of said lever under spring force of said spring mechanism by engagement with or release of said fitting mechanism from said ratchet mechanism.

3. A circuit breaker as set forth in claims 1 or 2, further comprising:

a tripping mechanism for releasing engagement of said ratchet mechanism from said fitting mechanism.

* * * * *